US005415255A

United States Patent [19]

Hafner

[11] Patent Number: 5,415,255

[45] Date of Patent: May 16, 1995

[54] CASE FORMED BY STACKED MODULE ELEMENTS

[75] Inventor: Hanspeter Hafner, Riedt, Switzerland

[73] Assignee: Lista Kunstofftechnik AG, Dozwil, Switzerland

[21] Appl. No.: 49,726

[22] Filed: Apr. 20, 1993

[30] Foreign Application Priority Data

Apr. 21, 1992 [CH] Switzerland ..... 284/92

[51] Int. Cl.[6] ..... B65D 21/036

[52] U.S. Cl. ..... 190/21; 190/107; 220/4.27; 220/6; 220/343; 206/503

[58] Field of Search ..... 206/372, 373, 503; 220/4.26, 4.27, 334, 343, 23.6, 6; 190/21, 107

[56] References Cited

U.S. PATENT DOCUMENTS

| | | | |
|---|---|---|---|
| 1,101,357 | 6/1914 | Thompson | 190/21 |
| 1,149,266 | 8/1915 | Johnson | 190/21 |
| 1,862,868 | 1/1932 | Sukoff . | |
| 2,702,116 | 2/1955 | Shnitzler et al. | 220/334 |
| 3,145,871 | 8/1964 | Cavanagh | 220/334 |
| 4,154,362 | 5/1979 | McKenney | 220/334 |
| 4,503,955 | 3/1985 | Fitzsimmons, Jr. . | |
| 4,705,316 | 10/1987 | Jardin . | |
| 4,896,926 | 1/1990 | Verholt | 220/4.26 |
| 4,998,616 | 3/1991 | Hillinger | 206/372 |

FOREIGN PATENT DOCUMENTS

| | | | |
|---|---|---|---|
| 480424 | 2/1948 | Belgium . | |
| 335595 | 9/1903 | France . | |
| 1275436 | 10/1961 | France . | |
| 2645416 | 12/1990 | France . | |
| 418006 | 8/1925 | Germany | 206/503 |
| L8861 | of 1912 | United Kingdom . | |
| 313836 | 7/1929 | United Kingdom . | |

*Primary Examiner*—Stephen J. Castellano
*Attorney, Agent, or Firm*—Egli International; Christa Hildebrand

[57] ABSTRACT

In a case for receiving and transporting articles, in particular tools and working material, comprising at least one lower part (28*a*) with a base (28*a*) and a lid, which are jointedly connected to one another by a hinge and have a locking device, the case is of a unitised construction. The lower part forms a module which can be connected to further modules by hinges.

14 Claims, 14 Drawing Sheets

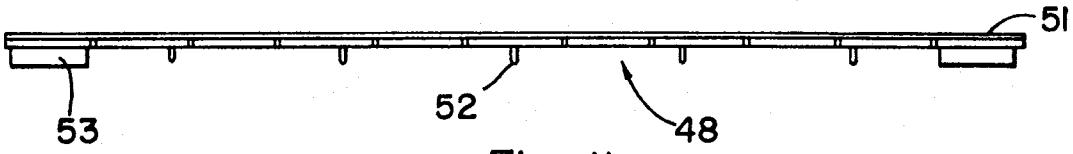
Fig. 11
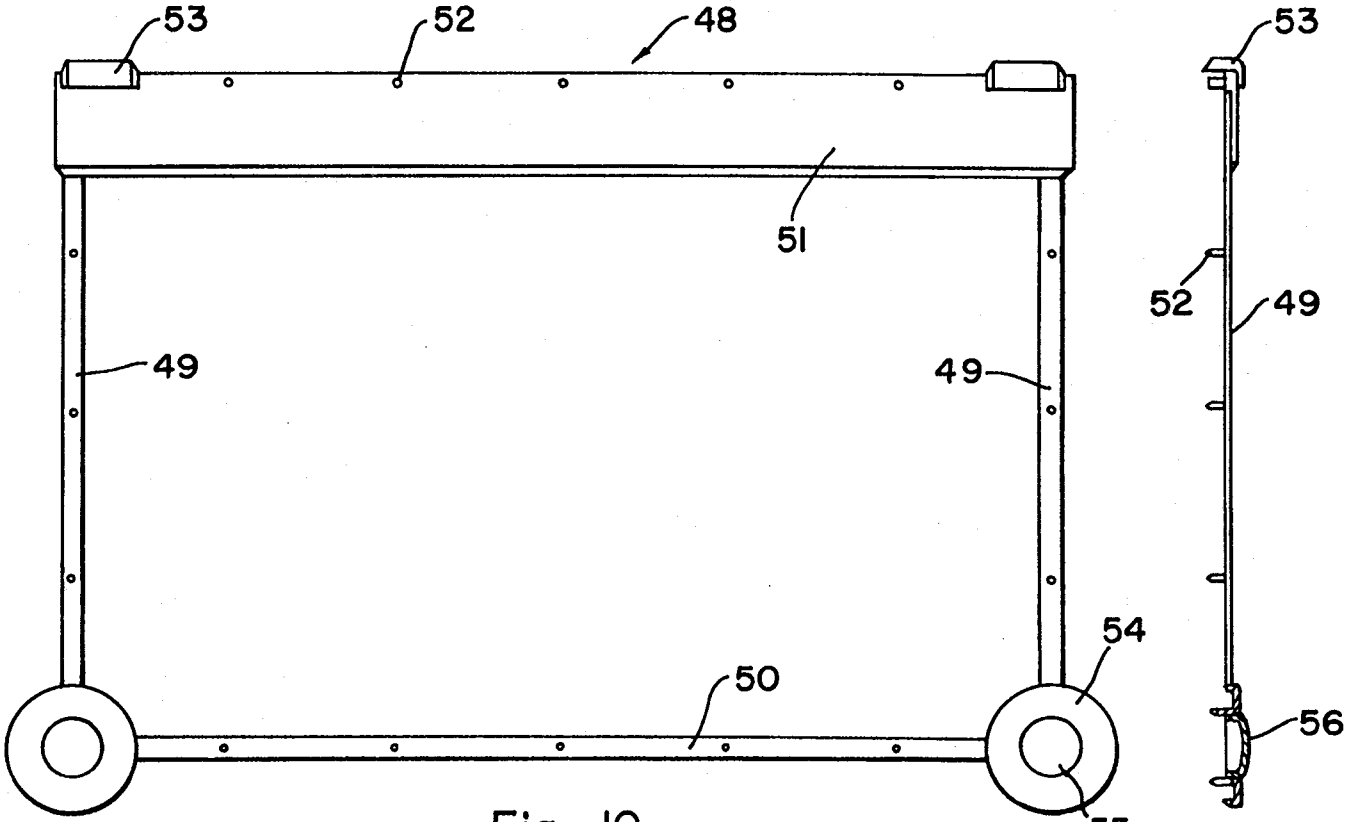
Fig. 12
Fig. 10

CASE FORMED BY STACKED MODULE ELEMENTS

The invention relates to a case for receiving and transporting articles, in particular tools and working material, comprising at least two elements, which are jointedly connected to each other by means of at least one hinge and of which a lower element is designed as a receiving space for receiving and transporting the articles and an upper element is designed as a lid for the lower element, the case having at least one locking device for securing a relative position of the elements with the receiving space closed by the lid.

Such tool cases are known in a variety of forms and designs. It generally involves a simple case shell which is covered by means of a lid, the content of the case shell being accessible after raising the lid. These cases may be shaped from metal or plastic, but are very restricted in their function, since only a predetermined receiving space and a single fixed position of a carrying handle in relation to the receiving space are available.

The same also applies to known tool boxes, which can be swung open in a way similar to sewing boxes. In addition, the content of these tool boxes is relatively difficult to access, in particular in the lower region.

The present invention is based on the object of developing a case of the type mentioned at the beginning which does not have these disadvantages, is variable in its function, can be expanded in its receiving space at the carrying handle, preferably while approximately maintaining balance, and in which the content is easily accessible to the user.

To achieve this object, a case of the type mentioned at the beginning is characterized in that in the case of unitised construction each element designed as a receiving space is a module of a modular system, which can be stacked on one of further modules of the modular system.

Consequently, the case comprises modules which, according to requirements, can be stacked one on top of the other and can be connected or are connected in an easily releasable manner to one another, consequently the overall receiving space available can be extended or else reduced again at any time in a unitised manner as desired.

Each module preferably has at least one basic shell having a base and a peripheral side shell having two side walls, a rear wall and a front wall, hinge sleeves being located on the rear wall.

The side walls, the rear wall and the front wall are preferably of a double-walled design, an outer skin and an inner skin enclosing a peripheral inner chamber. This inner chamber serves for receiving further elements for the unitised extension of the case. Into the inner chamber of the side walls there may in each case be fitted a slide track, which interacts with the next-following module by a slide on a connecting rod. This slide track is of a specific design and serves overall for easy use of the case, while allowing easy assembly and modular extension of the case. What is essential here is that the lid or a module opens in relation to the following module lying underneath without acting on the connecting rod, can be held in the open position and can be closed again. This takes place by virtue of the fact that at least two positions of two modules are determinable with respect to each other in the interacting of slide and connecting rod, one of the positions being defined by a detent recess, the slide track having an elongated guide track and a flexible strip, the detent recess being located at the one end of the guide track, whereas the other end of the guide track, remote from the detent recess, together with the flexible strip forms a slit which can be varied in its width by elastic deformation of the strip, brought about by the slide.

This means and has the effect that the slide runs on the guide track into the detent recess, in which position the respective upper-lying element, i.e. the lid or another module, is then held in the open position. For returning the element into its position of rest, now the element simply needs to be raised a stage further, so that the slide runs out of the detent recess, it subsequently falling behind the detent recess and being able to slide back along a basic strip, described in more detail further below, until it reaches the flexible strip and forces its way there through the slit formed by the flexible strip and the guide track, so that it then comes to lie again above the guide track. This is an extremely simple sequence of movements which can be accomplished with just one hand, acting only on that element which is actually to be moved, i.e. the lid or another module.

The guide track mentioned above is preferably designed as a rising surface, forming together with a lower strip a clasp-shaped central part. As a result, it slopes into the detent recess and forms there an abutment for the slide, whereas the lower strip together with the abovementioned basic strip bounds a track for returning the slide into its position of rest.

The flexible strip preferably comprises a run-on strip and an adjoining sliding strip, which runs approximately in a plane of the guide track, whereas the run-on strip engages under the central part or the guide track. The sliding strip is thus located approximately in the plane of the guide track and then bends off towards the run-on strip. Near this bend, the abovementioned slit is formed with the end of the guide track. Normally, the slit has a width which in any event is less than the diameter of the slide. Consequently, provided that it is located above the guide track or on the sliding strip, the slide runs over and beyond this slit. If, however, it comes from below, guided on the run-on strip, to the slit, this slit limits its movement until the slit has opened to a width such that the slide can run through the slit.

The run-on strip is preferably adjoined by an elongated basic strip, which runs under the guide track and also engages under the detent recess. As a result, good guidance of the slide under the guide track is ensured. The basic strip runs under the guide track and also under the detent recess, so that if the slide falls out or slides out of the detent recess the slide can fall onto this basic strip and then be guided along this basic strip.

At its end remote from the run-on strip and the flexible strip, the basic strip preferably leads to an outlet out of the element. This makes it possible for the strip on the one hand to be introduced conveniently into the guide track, on the other hand if desired to be removed from the guide track, in order to release one element from the other.

The detent recess is preferably bounded by a first hook, which together with a second hook and in extension of the guide track beyond the detent recess forms a passage for the slide, through which the slide can go onto the basic strip. This ensures that, after it is moved beyond the detent recess into the passage, the slide can then slide back easily in the opposite direction. In the case of this design, preferably the one hook is approximately straight and the other hook curved, in order to accomplish in extension of the guide track beyond the detent recess on the one hand and the arresting of the slide which is distinctly tangible for an operator in front of the region of the passage for the slide, and on the other hand a guidance of the slide which is distinctly tangible for an operator in the region of the passage for the slide.

In this arrangement, the outlet is preferably located in a covering strip of the slide track, from which the second hook also bends off and which engages over the guide track. Consequently, the second hook runs away from the covering strip, in order to form together with the other hook the passage for returning the slide.

Preferably, the slide can be moved out of the detent recess against a flexible resistance of a securing element and, if appropriate, can be moved into the detent recess. In this arrangement, the securing element may preferably be designed as a flexible securing strip, which is arranged on a covering strip of the slide track approximately opposite the detent recess and together with the rising surface forms a constriction for the passing of the slide, it preferably being possible for the second hook and the flexible securing strip to be molded on together as an integral part on the covering strip. Consequently, the slide must press away the securing strip in order to come out of the detent recess through the constriction or else, if appropriate, to go into the detent recess. Other designs of the securing element are also conceivable, for example as a securing cushion of foam etc. This achieves the effect that the slide does not move inadvertently out of the detent recess, but instead can only fall behind the detent recess and slide back along the basic strip when it is desired for the element to return from the one position, defined by the detent, into the other position.

In the case of the lowest module in the modular system, which thus forms the lower part of the case, no hinge needs to be provided on the rear lower edge of the module. However, in the case of modules which form central parts of the case, a hinge must be provided, since this provides a means of connection to the hinge of the lower part or module arranged thereagainst. For this purpose, one or more hinge parts are fitted from below into the inner chamber of the rear wall and fixed there. Each hinge part preferably has two hinge sleeves, which form between them a space for receiving a hinge sleeve of the following basic shell. For the sake of simplicity, the hinge sleeves are seated on a bow, in which a wall is provided from which at least one resilient tongue has been shaped out, for example, by punching or the like. When pushing the hinge part into the inner chamber of the rear wall, this resilient tongue interacts with a detent nose in the inner chamber, so that the resilient tongue snaps in behind this detent nose in the end position of the hinge part.

In a particularly preferred exemplary embodiment of the invention, the locking device is located in isolated columns, which are molded onto the corner regions between front wall and side walls. The columns comprise a tower-like wall and are closed at the top by a column top. In the column top there is, however, an opening, into which a locking bar or a detent hook of a locking bar of the following module can engage, so that this detent hook engages under the column cover in the closed position.

Preferably, the locking bar is fixed on a bats-wing-shaped plate, which is inserted from below in a column and fixed, for example, by screws. The main part of the locking bar is a locking-bar body, which is shaped approximately in the manner of segments of a circle. At its one end, this locking-bar body is seated by means of a pivot bolt in a pivot hole, it being able to pivot about this pivot bolt in the pivot hole. In this arrangement, it is supported by means of a spring leg on a rib, which rises up from the plate into the interior of the column. This spring leg has the effect that an opposite stop edge of the locking-bar body strikes against a further rib, so that the locking-bar body is held between these two ribs, but can move against the force of the spring leg. This movement is effected by a push bar, which is located on the outside of the column, but after engaging around a column lower edge and engaging through an arc segment in the plate is in connection with the locking-bar body. Incidentally, this arc segment is also engaged through by the detent hook.

By simple displacing of the push bar along the surface of the column, the detent hook is moved out of its closing position into an opening position, in which it no longer engages under the following column top, or a locking-bar edge provided there, so that the locking of the columns on one another is released.

Furthermore, in each column there is preferably an undercut groove for receiving a correspondingly designed molding on a carrying handle. This carrying handle may be fixed on any desired module of the case, by the moldings being pushed into the undercut groove and the remaining groove openings being closed by compensating pieces. A difference between the height of the moldings on the carrying handle and the undercut groove can also be compensated by compensating pieces. The advantage of these measures is that the carrying handle can be fitted on any desired module and at any height thereupon by means of compensating pieces, so that the carrying handle can be optionally arranged approximately over the expected center of gravity of the loaded case and the case spontaneously maintains an acceptable position during carrying. By fitting onto a selected module, the carrying handle can be broadly positioned, and by means of the compensating pieces the carrying handle can additionally be finely positioned as well.

As mentioned above, there need not be any rear hinge parts in the lower part of the case. Furthermore, there the columns are also not closed by the locking bolts through plates. Instead, a blind frame is provided, which closes both the downwardly open inner chamber of the rear wall and the inner chamber of the side walls, the front wall and the columns. This blind frame preferably also has small feet and caps, which interact with corresponding recesses and small feet on a lid of a following case, so that corresponding cases can also be stacked one on top of the other.

The connection of the blind frame to the basic shell is performed by clip connections, corresponding detent hooks on the blind frame engaging over detent noses on the basic shell.

The lid is also designed similarly to a basic shell or a module, although it does not have a base but a covering plate. Its corresponding columns are of course of a lower design and covered at the top by a lid sheet, molded into which incidentally is the recess just mentioned, which interacts with a cap of a case placed on top.

In the rear region of the covering plate as well there is a cover, which has the feet just mentioned.

In a particular embodiment, the modules of the case according to the invention should be usable not only for the case itself but also as a drawer. Here it is possible to clip onto a module a handle frame, which has in particular a handle. A module equipped in this way is then placed on a drawer arrangement of a rack and can then be moved as a drawer into or out of the rack. If the module is then to be transported again, the handle frame can be readily detached and the module fitted back into a case. In this way a variable and versatile case which can be easily assembled and easily changed is obtained.

Further advantages, features and details of the invention emerge from the following description of preferred exemplary embodiments and with reference to the drawing, in which.

Figure 8A:
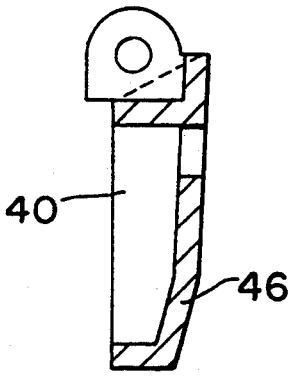
FIG. 8 shows a side view of a hinge part according to the invention for fitting into a basic shell according to FIG. 4.
Figure 8B:
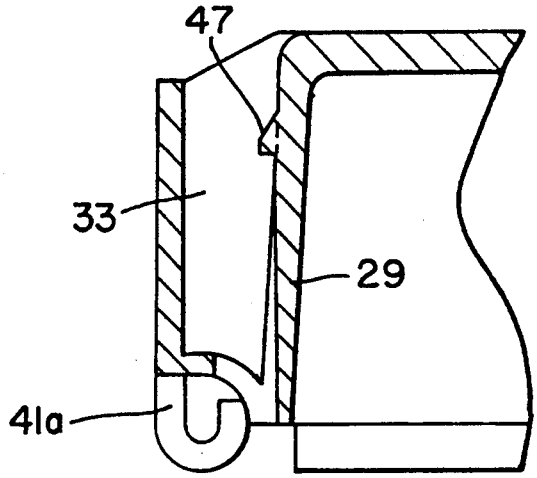

FIG. 8*a* and 8*b* show a cross section of the hinge.

Figure 4:
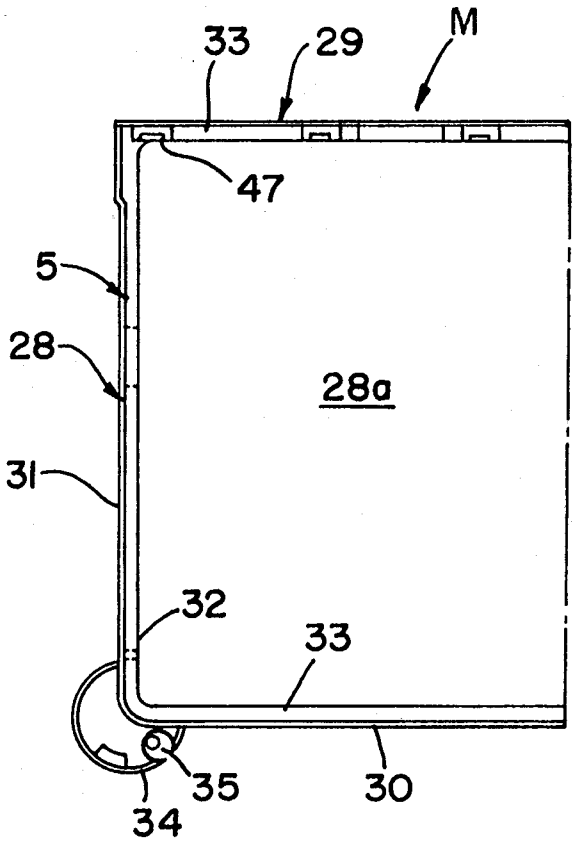
FIG. 4 shows a partially represented lower view of a basic shell.
Figure 9:
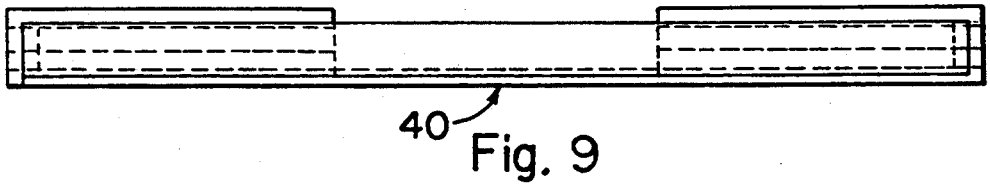
Figure 8:
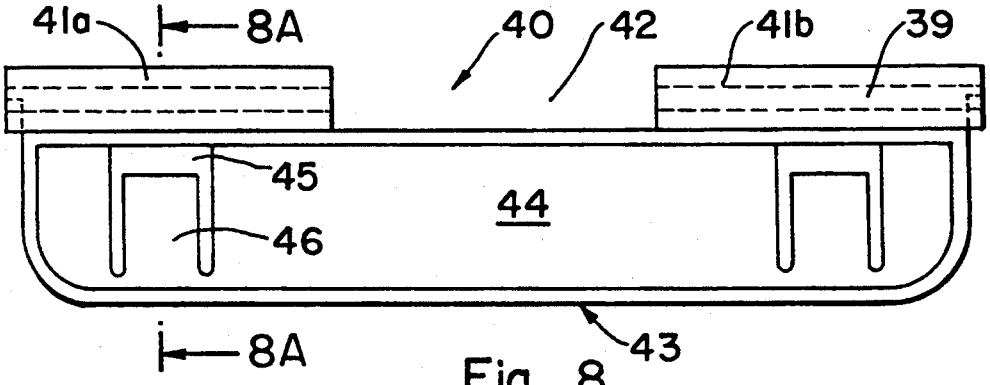
Figure 15:
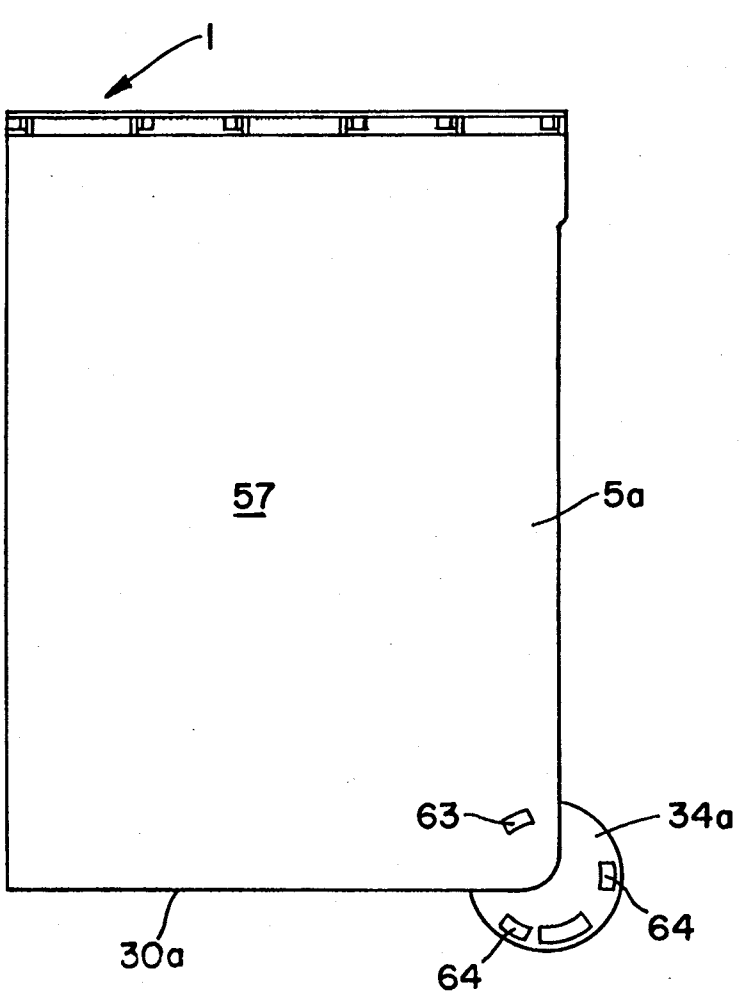
Figure 14:
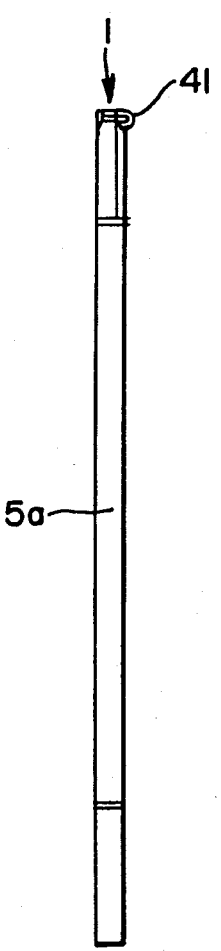
Figure 13:
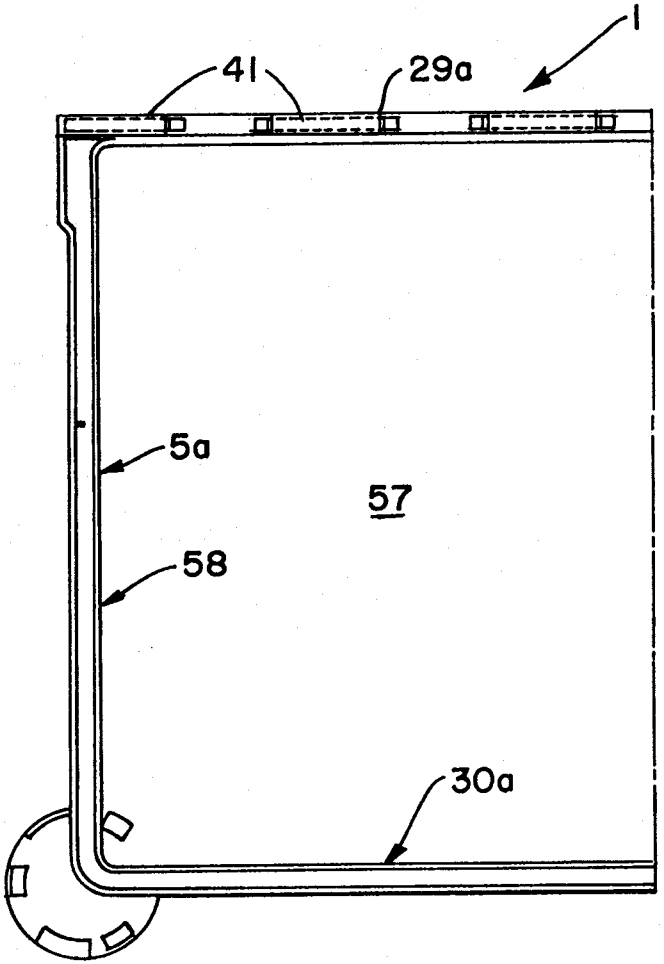
Figure 16:
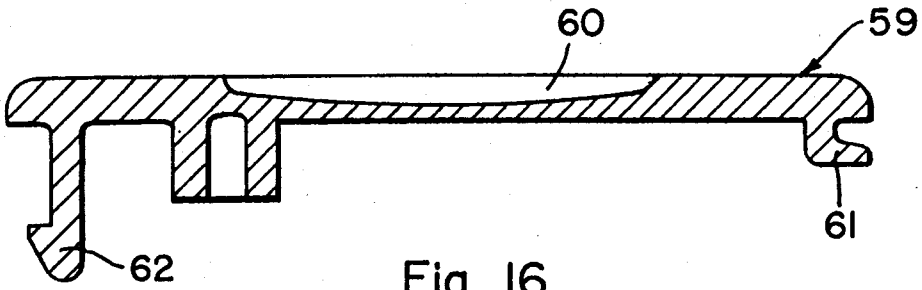
Figure 17:
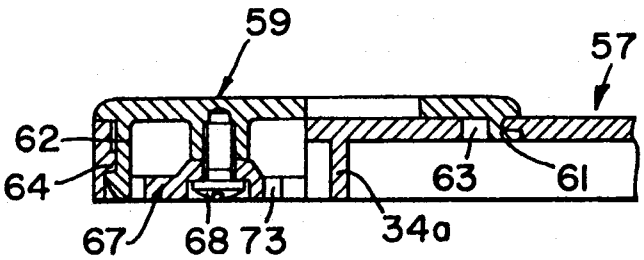
Figure 18:
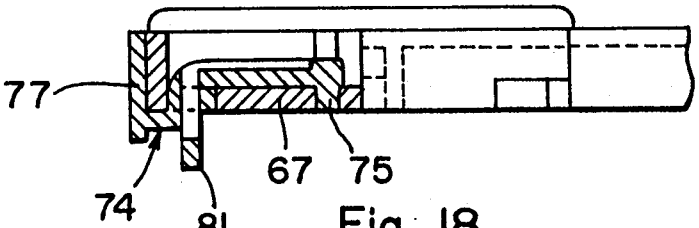
Figure 19:
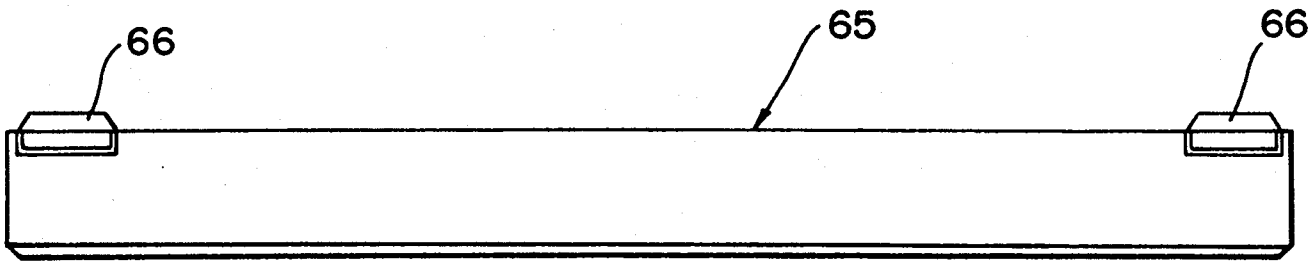
Figure 21:
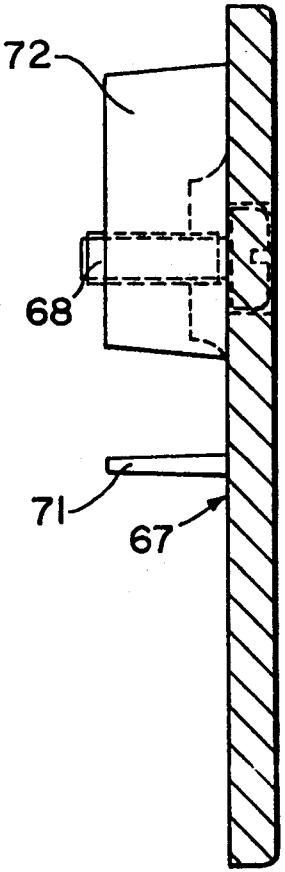
Figure 20:
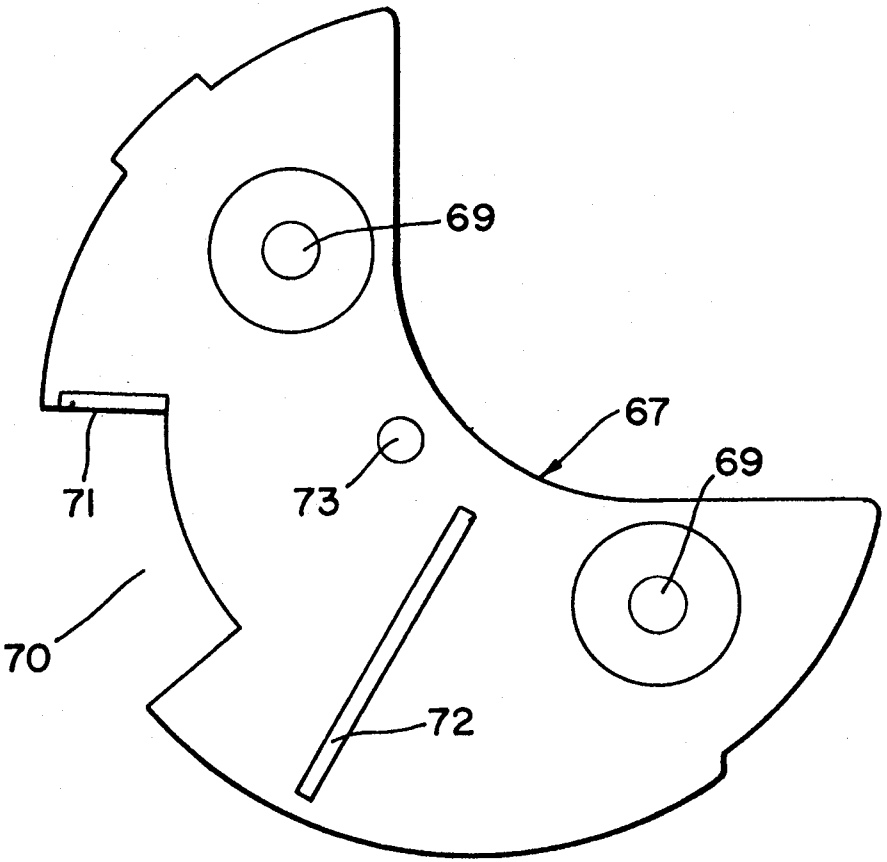
Figure 22:
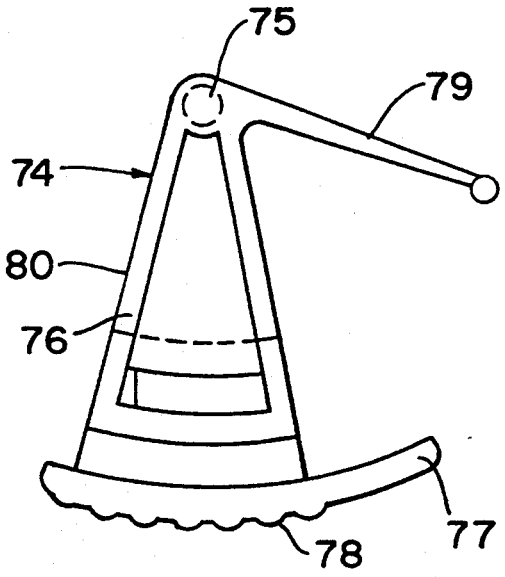
Figure 23:
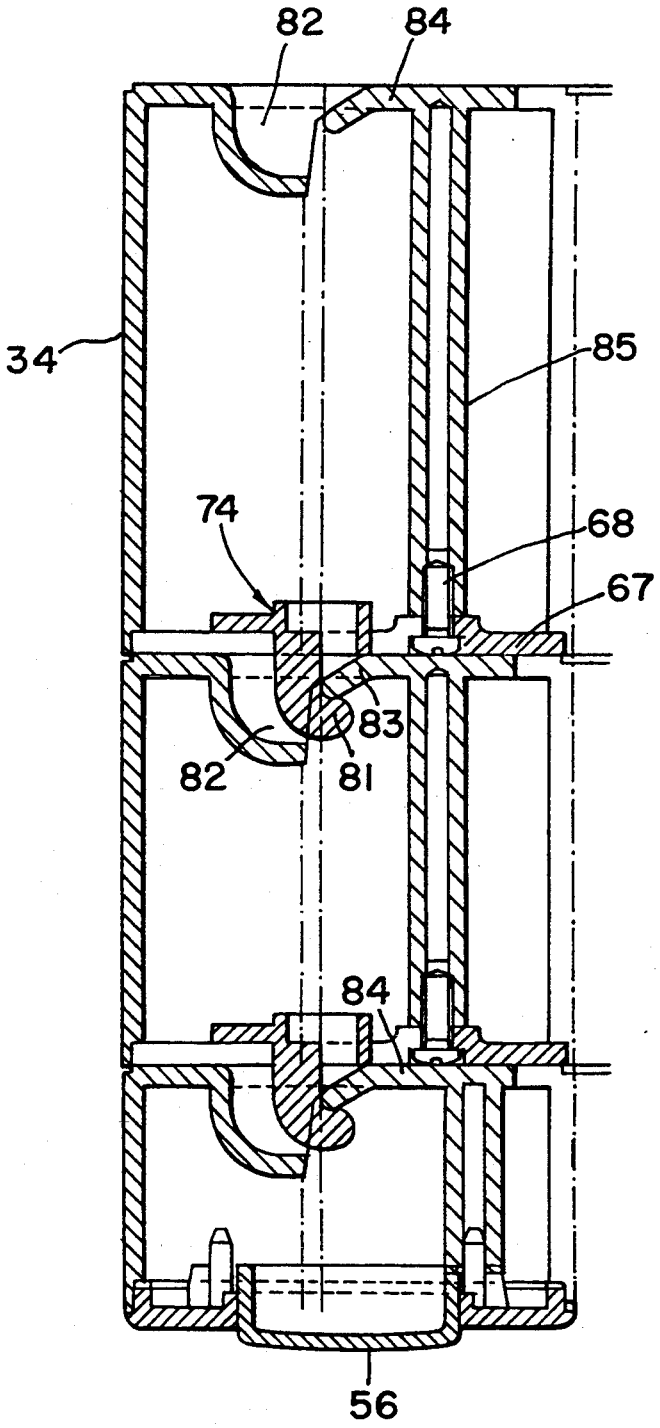
Figure 24:
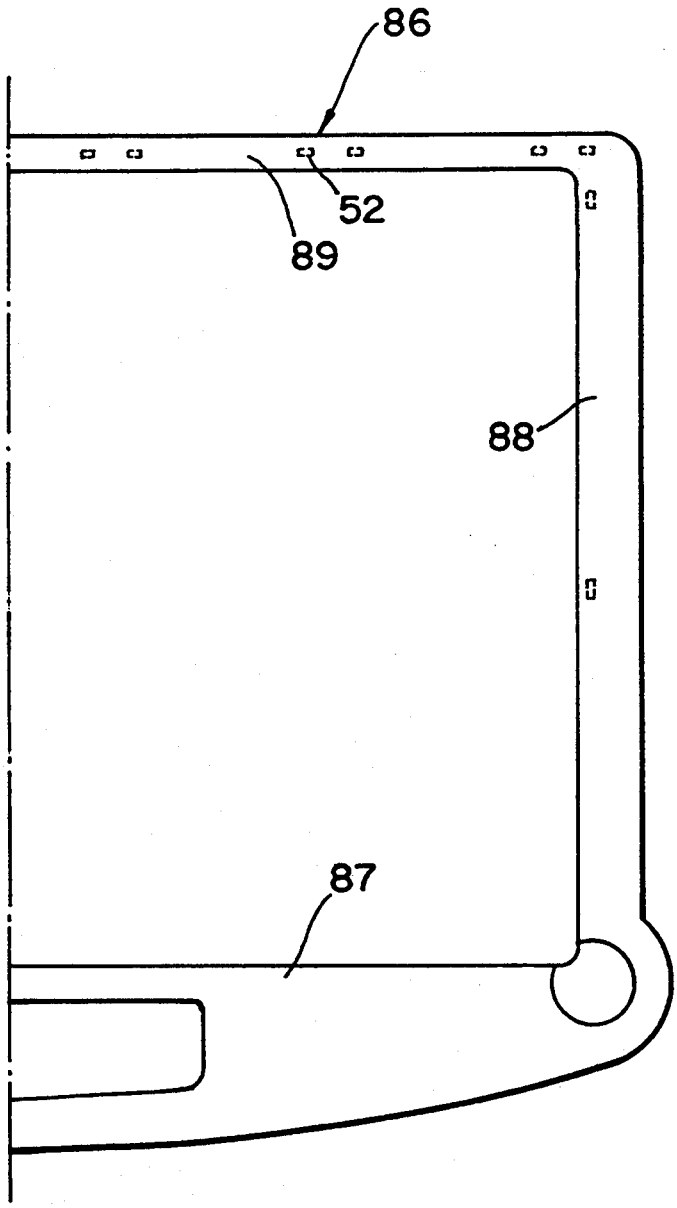

FIG. 9 shows a plan view of the hinge part according to FIG. 8;

FIG. 10 shows a plan view of a blind frame according to the invention for placing on a lower surface of a basic shell according to FIG. 4;

FIG. 11 shows a front view of the blind frame according to FIG. 10;

FIG. 12 shows a side view of the blind frame according to FIG. 10 with a fitted cap;

FIG. 13 shows a partially represented inner view of a lid according to the invention;

FIG. 14 shows a side view of the lid according to FIG. 13;

FIG. 15 shows a partially represented plan view of the lid according to FIG. 13;

FIG. 16 shows a cross-section through a lid sheet for closing a column of a lid;

FIG. 17 shows a partially represented cross-section through the lid according to FIGS. 13 and 15 with fitted lid sheet and parts of a locking device;

FIG. 18 shows a cross-section similar to FIG. 17 through part of the lid;

FIG. 19 shows a plan view of a cover for the lid;

FIG. 20 shows a plan view of a plate as part of the locking device;

FIG. 21 shows a cross-section through the plate according to FIG. 20;

FIG. 22 shows a plan view of a locking bar as part of the locking device;

FIG. 23 shows a longitudinal section through columns of modules stacked one on top of the other in the region of the locking device;

FIG. 24 shows a partially represented plan view of a handle frame; and

Figure 25:
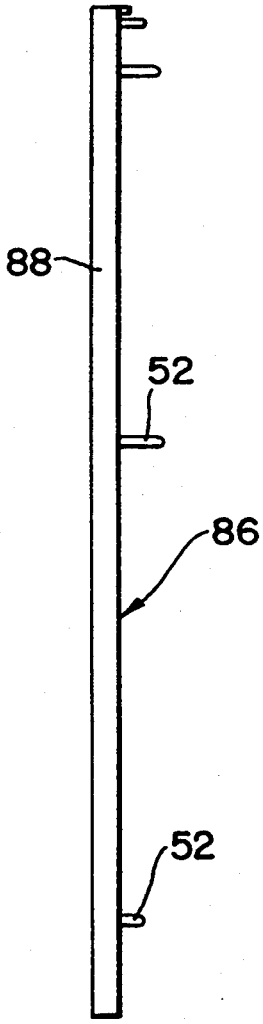

FIG. 25 shows a side view of the handle frame according to FIG. 24.

Figure 1:
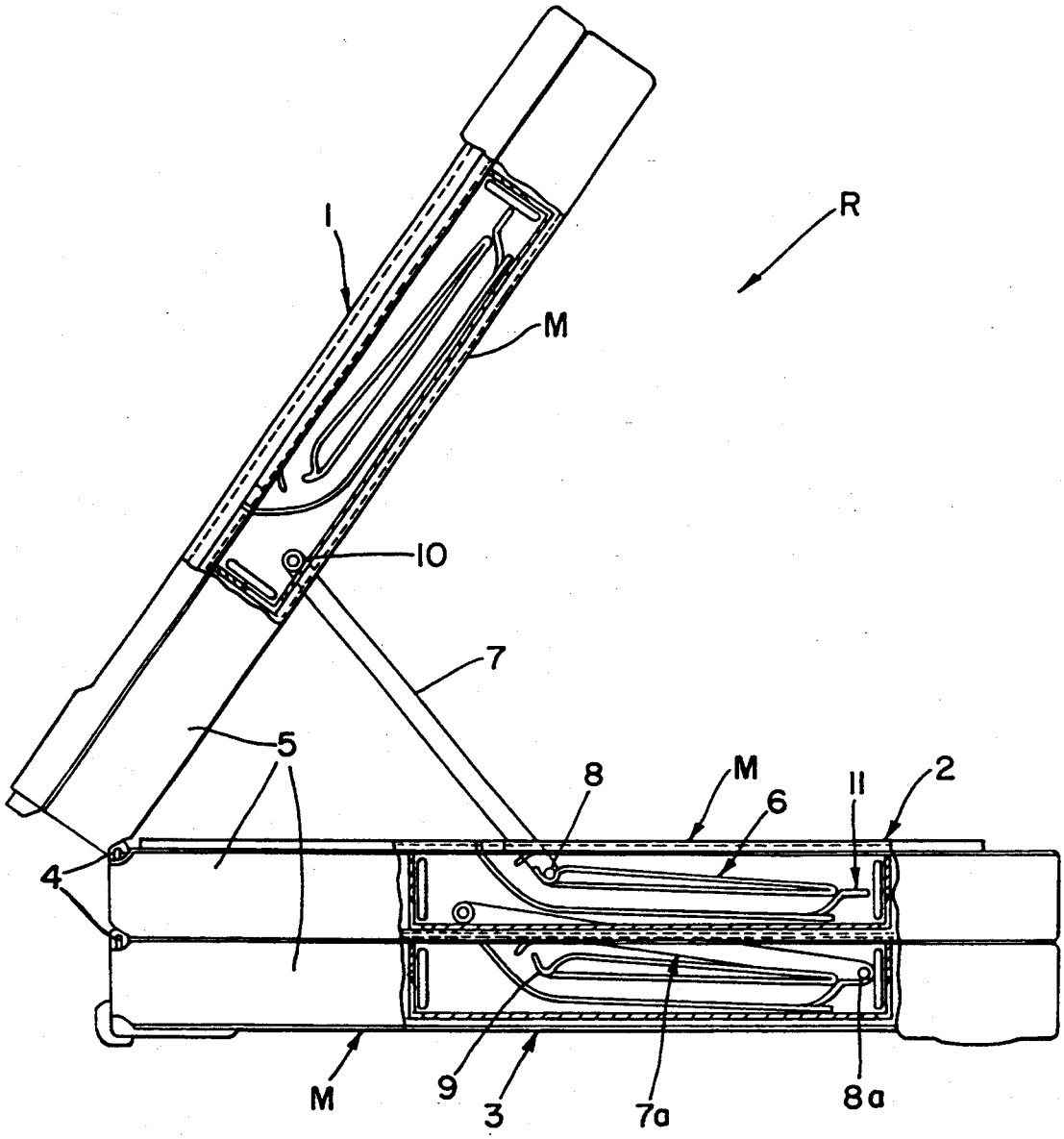
FIG. 1 shows a side view of an opened case with slide tracks according to the invention.

A case R is constructed according to FIG. 1 from individual modules M and has a lid 1 and a lower part 3. A number of central parts 2 may be arranged in between. In the design represented as an example in FIG. 1, two central parts 2 are provided, but the lid 1 could also be directly adjacent to the lower part 2.

In each case, two of these elements which are adjacent are connected to each other by means of a hinge 4, about which they can be pivoted in relation to each other. In the design represented in FIG. 1, the lid 1 is connected to a central part 2, which is connected to another central part 2 and the latter is connected to the lower part 3 by means of a respective hinge 4. As a result, the lid 1 can be raised by the one adjacent central part 2, the one central part 2 can be raised by the other adjacent central part 2, or the other central part 2 can be raised by the adjacent lower part 3, in order to make the content of the central part 2 or lower part 3 concerned accessible.

Integrated into the side wall 5 of the central part 2 and of the lower part 3 there is in each case at least one slide track 6, which interacts with in each case a connecting rod 7 articulated on the element respectively lying above. In the lid 1 there is likewise articulated a connecting rod, but no slide track is integrated.

The connecting rod 7 is shown in a position for use in which the two central parts 2, connected by this connecting rod 7, are located in an opening position and are supported in a secured manner. This takes place by virtue of the fact that a slide 8, which is designed for example as a bolt fixed on one end of the connecting rod 7, is located in a detent recess 9 of the slide track 6 of the lower of the two connected central parts 2. At its other end, the connecting rod 7 is articulated by means of a pivot joint 10 on the side wall 5 of the upper of the two connected central parts 2 and connected, if appropriate releasably.

The connecting rod 7*a* is shown in a position for use in which the two elements connected by this connecting rod 7, namely the lower part 3 and the abovementioned lower of the two central parts 2, are located in a closing position. Here, the connecting rod 7*a* is thus articulated by means of a pivot joint 10 on the side wall 5 of the central part 2 just mentioned and connected, if appropriate releasably, whereas the corresponding slide 8*a* is supported on a flexible strip 11, described in more detail further below, of that slide track 6 which is arranged on the lower part 3.

The slide track 6 is now to be explained in more detail with reference to FIG. 2. In particular, various stages of the interacting of the slide track 6 with the connecting rod 7, or the slide 8, are represented by dashed and dot-dashed lines.

The position of rest of the slide track 6 is identified by I. In this position of rest, the slide 8 rests on the flexible strip 11.

If then, for example, the upper of the two elements connected by the connecting rod 7 (element 1 or 2) is raised from the lower of the two elements (element 2 or 3), the slide 8 first of all runs for a while on part of the flexible strip 11, and then it slides along a guide track 12 which is designed as a rising surface and forms together with a lower strip 13 a clasp-shaped central part 14 of the slide track 6. Towards its end, the slide track 12 slopes towards the detent recess 9 and it is coupled or connected or operatively connected there to the lower strip 13. Together with the lower strip 13, after the detent recess 9, i.e. in extension of the guide track 12 beyond the detent recess 9, an upwardly directed first hook 15 is formed, which together with a downwardly directed second hook 16 forms a passage 17. The upwardly directed first hook 15 is approximately straight and the downwardly directed second hook 16 is curved.

This second hook 16 is integrally molded onto a covering strip 18 of the slide track 6, which for its part also upwardly bounds a chamber 19 of the element 2 or 3, in which the slide track 6 and also the guided slide 8 are located. The second hook 16 protrudes downwards from the covering strip 18 approximately opposite the detent recess 9 and is at least partially designed as a flexible securing strip, in order to act as a securing element for the slide 8. Together with the guide track or rising surface 12, the second hook 16, or the part thereof acting as a securing strip, provides a constriction for the passing of the slide 8 just in front of the passage 17. In order to reach the passage 17, the slide 8 must first of all run through the said constriction, which takes place against the flexible resistance of the securing strip. Consequently, the slide 8 must press the hook or securing strip 16 flexibly away in order to come out of the detent recess 9, or else if appropriate to go into the detent recess 9, through the constriction.

The chamber 19 has only one outlet 20, which is arranged approximately in extension of the guide track beyond the detent recess and the second hook 16. Through this outlet 20, the slide 8 can be introduced into the chamber 19 and brought out again, so that the two elements considered can be connected to each other and released from each other by the connecting rod 7.

For closing the upper of the two elements onto the lower one, the upper element is raised, so that the slide 8 slides along the first hook 15 and is guided by the second, curved hook 16 against the flexible resistance of the securing strip out of the passage 17 in such a way that the connecting rod 7 is then located in the intermediate position, identified by II and represented by dashed lines. From then on, the connecting rod 7 no longer prevents the closing of the upper element onto the lower one, since the slide 8 can then run along a basic strip 21 until, at the end of the basic strip 21, it runs onto a run-on strip 25 of the flexible strip 11. This run-on position is identified by III, the run-on strip 25 forming a stop for the slide 8 and, as a result, limiting the movement of the connecting rod 7.

The shape of the two hooks 15 and 16, together with the securing element, produces for the operator who is actuating the connecting rod 7 on the one hand a distinctly tangible arresting of the slide 8 in front of the region of the passage 17, on the other hand a distinctly tangible guidance of the slide 8 in the region of the passage 17 itself, in order that the said slide cannot inadvertently slide through the outlet 20 out of the element considered, but only when desired.

The flexible strip 11 together with the end of the clasp-shaped central part 14 more remote from the detent recess 9 forms a slit 22 which is variable in its width b, the slide 8 forcing itself into this slit 22 when running onto the flexible strip 11 and, as it does so, the flexible strip 11 yielding due to enlargement of the width b. As a result, the slide 8 can slide through the slit 22 and in this way go back into its position of rest I. After the slide 8 has passed through the slit 22, the latter closes again to the width b, so that when opening or raising the upper of the two elements from the lower one the slide 8 can slide away over this slit 22 and not undesirably go back downwards through the slit 22.

Accordingly, the entire flexible strip 11 comprises a sliding strip 24 which runs approximately in the plane of the rising surface 12 and the end of which lies in the vicinity of the run-on strip 25, and of a run-on strip 23 which adjoins this sliding strip 24, thereby forming the slit 22 with the central part 14, and itself is connected to the basic strip 21 and merges with the latter.

Figure 2:
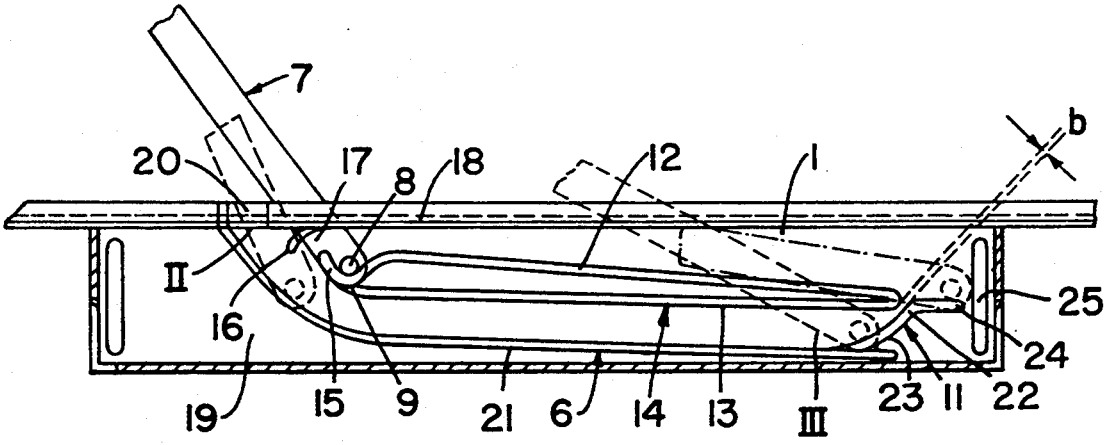
FIG. 2 shows an enlarged cutout from the case according to FIG. 1 in the region of the slide tracks.
Figure 3:
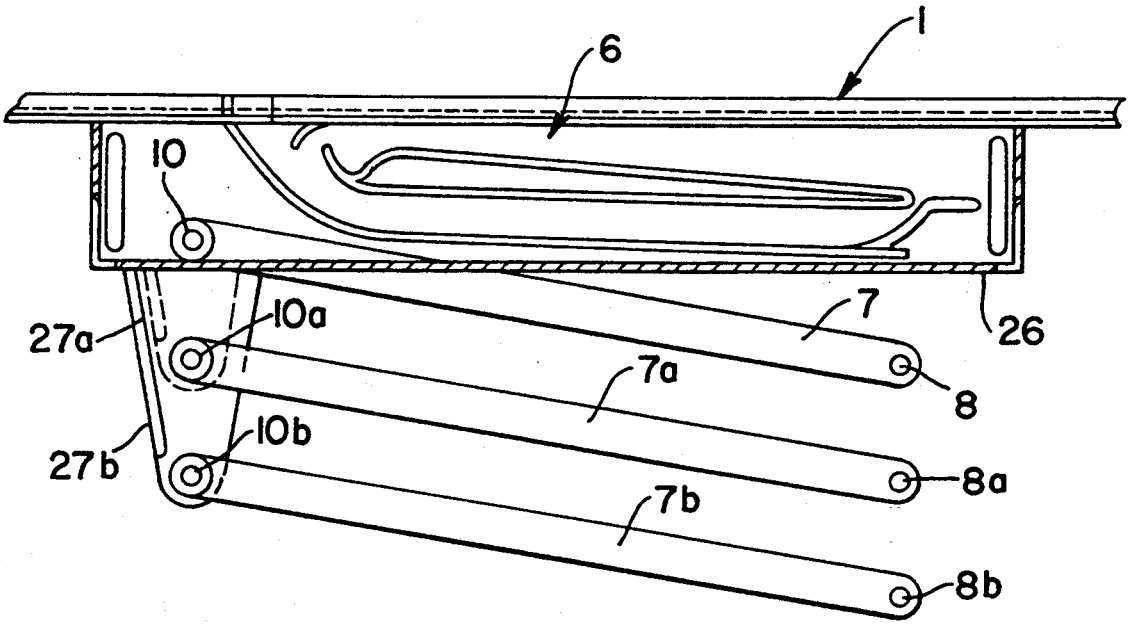
FIG. 3 shows an enlarged cutout from a further exemplary embodiment of a case according to FIG. 1 in the region of the slide tracks.

Whereas in the exemplary embodiment of a case R according to FIGS. 1 and 2 all the modules have the same height and it is always so in each case that a following module M is connected by means of a connecting rod 7 to the next module, in FIG. 3 a possibility of connecting modules of different heights is indicated. In the modular system the various modules are graduated in their height in accordance with a modular height difference which is equal to the vertical spacing of the possible positions of the connecting rod 7, **7*a*, 7*b* drawn-in in FIG. 3, whereas the modules are otherwise essentially identical to one another in their design. On the slide track 6, or on its housing 26, there may then be arranged tongue-shaped lugs 27*a* and 27*b*, which in each case have a pivot joint 10*a* and 10*b* for the connecting rod 7 if the latter is to be in the position or at the height 7*a* or 7*b*. With the aid of the respective tongue-shaped lugs 27*a* and 27*b* of different lengths, consequently the pivot joint of the connecting rod can be brought to the positions 10, 10*a* or 10*b*, corresponding to the positions of the connecting rod 7, 7*a* or 7*b*, in order to adapt the slide 8, 8*a* or 8*b*** at the end of the connecting rod to the height at which the slide track of the downwardly following module lies.

Figure 6:
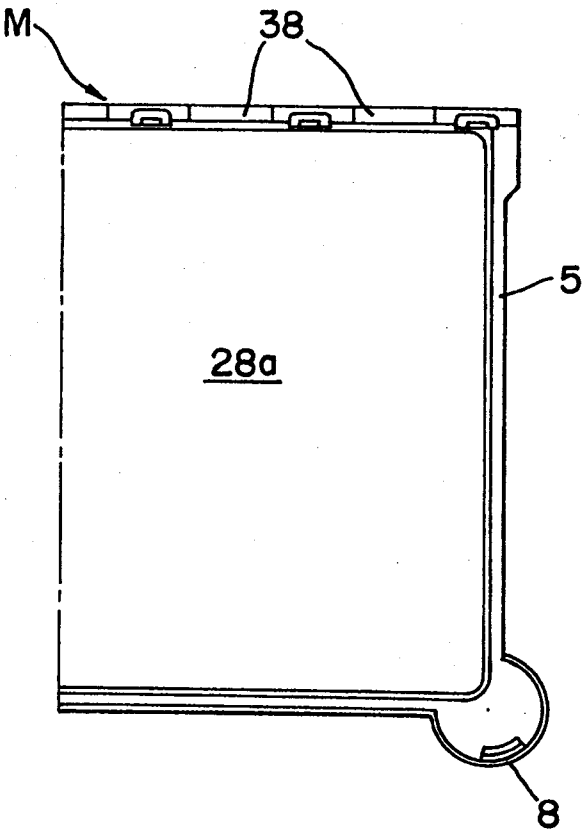
FIG. 6 shows a partially represented plan view of the basic shell according to FIG. 4.
Figure 5:
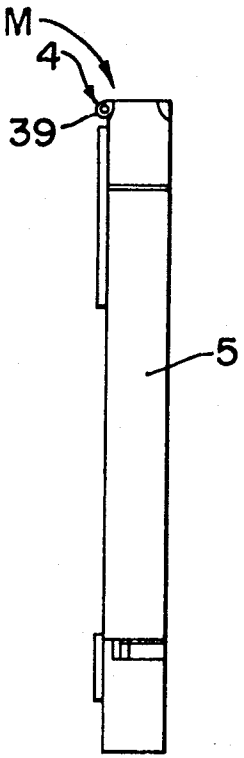
FIG. 5 shows a side view of the basic shell according to FIG. 4.

According to FIGS. 4 to 6, each module M comprises a basic shell 28 and a peripheral side shell having two side walls 5, a rear wall 29 and a front wall 30. Together with the rear wall 29 and the front wall 30, the side walls 5 run around a base **28*a*. Furthermore, side walls 5, rear wall 29 and front wall 30 are of a double-walled design, an outer skin 31 enclosing an inner skin 32, and the two together forming a peripheral inner chamber 33. Fitted into the inner chamber 33 of the side wall 5 there is then, for example, the slide track 6 described above, which however has been omitted in FIGS. 4 to 6. Furthermore, a hinge part may be fitted into the peripheral inner chamber 33 of the rear wall 29**, as is described later.

Figure 7:
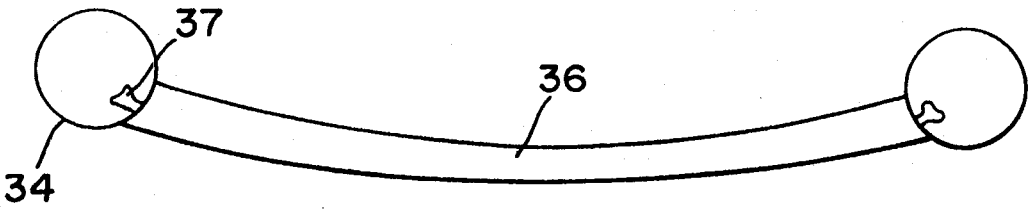
FIG. 7 shows a plan view of a handle for use on a case according to FIG. 1 in the position for use.

Also molded onto the two corner regions between the side walls 5 and the front wall 30 are columns 34, which perform various functions. They essentially serve for receiving locking-bolt parts, described later. According to FIG. 4, it can be seen that the columns 34 also have an undercut groove 35, into which a handle 36, shown in FIG. 7, can be fitted. For this purpose, this handle 36 has on both its sides a corresponding molding 37, which has an outer contour which corresponds to the inner contour of the undercut groove 35. This molding 37 is pushed into the undercut groove 35 and after that this undercut groove 35 is closed from both sides by compensating pieces. As already mentioned, the carrying handle can be finely positioned by means of the compensating pieces, in order to lie optimally at a desired height.

A further essential point of the present invention is the design of the hinges 4. In FIGS. 5 and 6 it can be seen that hinge sleeves 38 spaced apart from each other are molded-on in the rear wall 6. The hinge sleeves 38 are passed through by an axial bore 39, it being possible for a hinge rod, not shown in any more detail, to be pushed through the axial bores 39 of all the hinge sleeves 38 of a module M. This hinge rod is secured against falling out by corresponding notches at both its ends. When releasing two modules, this hinge rod is again withdrawn from the hinge sleeves 38.

The shaping of the rear wall 29 with respect to the hinge 4 depends on the purpose for which the corresponding module is to be used. In the exemplary embodiment according to FIG. 5, there is no connecting hinge opposite the hinge 4, so that here the module M can be used as a lower part 3. If, however, the module M is intended, for example, for a central part 2, there must be located opposite the hinge 4 a further hinge, which then can be coupled, for example, to the hinge sleeves 38 of a lower part 3. In this instance, hinge parts 40, which are shown in FIGS. 8 and 9, are fitted into the inner chamber 33 of the rear wall 29. These hinge parts 40 in each case have two hinge sleeves 41*a* and 41*b*, which leave between them a space 42 into which, in the position for use, a hinge sleeve 38 of the hinge 4 engages. The hinge sleeves 41 are also passed through by axial bores 39, through which the hinge rod (not shown) is pushed. As a result, a connection of all the hinge sleeves 38 and 41 takes place.

The hinge sleeves 41 are, furthermore, molded onto a bow 43, which runs around a wall 44. In the wall 44 there are two clearances 45, by which resilient tongues 46 are formed. When the hinge part 40 is pushed into the inner chamber 33 of the rear wall 29, these resilient tongues 46 are deflected and they snap in behind detent noses 47, which engage in the clear width of the inner chamber 33. As a result, the hinge part 40 is fixed in the rear wall 29 and it now serves for jointed connection to another module M.

If, on the other hand, a module M is used as a lower part 3, a blind frame 48 according to FIGS. 10 to 12 is provided. This blind frame 48 has two side strips 49, a front strip 50 and rearward covering strip 51. Molded onto all the strips there are upright hooks 52, by means of which the blind frame 48 can be fixed on rear wall 29, front wall 30 and the two side walls 5. For this purpose, the hooks 52 engage in the respective inner chambers 33 and they enter there into a clip connection with detent noses, not shown in any more detail.

On the covering strip 51 there can also be seen small molded-on feet 53, by means of which on the one hand the case R can be supported against an underlying surface, but which can also serve for centering this case R or module M with respect to a second case or module arranged underneath.

In the corner regions between front strip 50 and side strip 49 there can be seen in each case a ring 54, which in each case terminates a column 34 at the bottom. Made in the ring 54 is a central hole 55, in which a cap 56, shown in FIG. 12, is fitted. This cap 56 serves on the one hand for closing the column 34, but on the other hand also for centering and fixing a case in such a way that it will not slip on another case. The counterpiece for the cap 56 is then located on the lid 1 of the case lying underneath.

The lid 1 is shown in FIGS. 13 to 15. It essentially has a frame 58, which runs around a covering plate 57 and comprises double-walled side walls 5*a*, a front wall 30*a* and a rear wall 29*a*. On the rear wall 29*a* there are molded-on hinge sleeves 41, which interact with corresponding hinge sleeves 38 of the module M lying underneath.

In the corner region between the side walls 5*a* and the front wall 30*a* there is located a column 34*a*, which corresponds in its circumference to the columns 34 of the modules M. However, like the entire frame 58 as well, it is designed to be of a significantly lower height in relation to the modules M. This can be seen in FIG. 14.

The column 34*a* is open at the top and is covered during assembly of the case R by a lid sheet 59 (see FIG. 16). Molded into this lid sheet 59 is a recess, into which the abovementioned cap 56 can be fitted as a foot of a case arranged thereabove. The lid sheet 59 is clipped into the covering plate 57 and into the column 34, for which purpose the lid sheet 59 has detent hooks 61 and 62. In FIG. 17 it can be seen that the detent hook 61 moves into a clearance 63 of the covering plate 57, whereas the detent hooks 62 engage under corresponding detent noses 64 in the column 34a. As a result, a releasable fixing of this lid sheet 59 takes place.

In FIG. 1 it can also be seen that the rear region of the lid 1, and there in particular the hinge 4, is covered over by a cover 65, which is shown in more detail in FIG. 19. This cover 65 has hooks, not shown in any more detail, similar to the hooks 52 of the blind frame 48. By these hooks, the cover 65 is also fixed on the lid 1. Furthermore, the cover 65 has small feet 66, which correspond approximately to the small feet 53 on the blind frame 48. However, it is evident in FIG. 1 that these small feet are set slightly deeper in the rear wall, so that the small feet 53 which engage around the lower edge of the case R can lie on the small feet 66 if a further case is put down on the case R. As a result, by interacting with the cap 56, which is seated in the recess 60, a fixing of the case placed on top follows.

With a view to the interlocking of the case, on the one hand there is fitted from below into the column 34 or 34*a* a plate which, as FIG. 20 shows, has a bats-wing-like contour. Consequently, it corresponds to the column cross-section, which is approximately circular, but has a circle cutout through the edge engaging in the column between the side walls and the front wall. This plate 67 is fixed by means of screws 68, for example according to FIG. 17, on the lid sheet 59, the screws 68 engaging through corresponding screw holes 69.

Also cut out from the plate 67 is an arc segment 70, which is bounded at its one end by a rib 71. A further rib 72 is located on the plate 67 between a pivot hole 73 and a screw hole 69. The entire arrangement just described, comprising the arc segment 70, the ribs 71 and 72 and the pivot hole 73, serves for receiving and securing a locking bar 74, as represented in FIG. 22. After fixing of the plate 67, the locking bar 74 is pushed through the arc segment 70, which then together with the corresponding column 34 or 34*a* forms a push-in opening. The locking bar 74 has a molded-on pivot bolt 75 which, as shown in FIG. 18, is fitted into the pivot hole 73. In this way a pivot-jointed connection is produced between the locking bar 74 and the plate 67. The pivot bolt 75 is preferably in one piece with a segment-like locking-bar body 76 and molded thereupon at one end of it, whereas opposite the pivot bolt 75 there is located on the locking-bar body 76 a push bar 77 with a fluting 78.

Furthermore, a spring leg 79 protrudes from the locking-bar body 76 approximately radially with respect to the pivot bolt 75. In the position for use, i.e. when the pivot bolt 75 is seated in the pivot hole 73, the spring leg 79 strikes against the rib 72 and it presses the locking-bar body 76 with a stop edge 80 against the rib 71. In this position for use, a detent hook 8 (see FIG. 23) engages in a corresponding opening 82 of the column 34 lying underneath and there it engages under a locking edge 83. Incidentally, the locking bar 74 for the right-hand column 34 of the case R is shown in FIG. 22, whereas the left-hand columns are represented in FIG. 23. However, locking bars and columns correspond to one another and are arranged in a mirror-inverted manner.

For opening the locking bar, i.e. for drawing away the detent hook 81 under the locking edge 83, the push bar 77 is acted upon and the locking-bar body 76 pivots towards the spring leg 79 about the pivot pin 75. Since the spring leg 79 is striking against the rib 72, however, this takes place against a restoring spring force of the spring leg 79. On letting go of the push bar 77, the locking-bar body 76 moves back again into its starting position, the stop edge 80 striking against the rib 71. In this starting position, the detent hook 81 then engages again under the locking edge 83.

Incidentally, it is shown in FIG. 23 that the modules M, as described above, may be designed to be of different heights, but they are otherwise identical to one another. Furthermore, it can be seen that the columns 34 of the basic shells 28 are formed as essentially closed at the top, as is also indicated in FIG. 6. Only the opening 82 penetrates a column top 84, a small tube 85 being molded onto this column top 84. The screw 68 for fixing the plate 67 can be screwed into this small tube 85. Preferably, two such small tubes 85, and accordingly two screws 68, are provided.

Furthermore, a handle frame 86, which is shown in more detail in FIGS. 24 and 25, may be placed onto the basic shell 28. This handle frame 86 has a front handle bar 87, side bars 88 and a rear bar 89. In the corner regions as well, its contour is made to match the columns 34. This handle frame 86 can be clipped by means of corresponding hooks 52 onto a basic shell 28, so that then this entire arrangement can be placed as a drawer, for example, onto a corresponding drawer arrangement of a rack. The basic shell then does not serve for forming a case, but for forming a drawer.

As mentioned several times above, the connection of individual elements of the case takes place by means of corresponding clip connections. As an example, you are referred once again to FIG. 17. A clip connection is understood as meaning the interacting between a detent hook 62 and a detent nose 64. Shaped in a way corresponding to this detent hook 62 are also the hooks 52, which then likewise engage under corresponding detent noses in the basic shell or the lid.

The assembly and varying of the case is performed on the unitised principle.

A basic shell is taken to start with as the lower part 3, the blind frame 48 being clipped onto this basic shell. This basic shell is therefore not provided with hinge parts 40. In the blind frame 48, or in the locking bar 54 present there, are the caps 56.

In the simplest instance, the case may consist of just one module. Then, locking bars 74 are in each case laid on plates 67, the pivot bolt 75 being located in the pivot hole 73 and the spring leg 79 striking against the one rib 72, and consequently the stop edge 80 of the locking bar 74 pressing against the other rib 71. Then, this plate 67 is fitted into the respective column of the lid 1 and fixed by screws. In this arrangement, the locking bar 74 engages around a column edge, so that the push bar 77 strikes against the column 34*a* from the outside. The lid 1 is placed onto the lower part 3, so that the hinge sleeves 41 engage between the hinge sleeves 38 of the lower part 3. The connection then takes place by means of a hinge rod, which is pushed through the hinge sleeves. Now all that is needed is to place the cover 65 on the lid 1 and push the carrying handle 36 with its moldings 37 into the undercut grooves 35 of the columns 34, whereby a case is produced.

If the case is to comprise a plurality of modules or be extended to a plurality of modules, the lid 1 is released from the lower part 3 by drawing the hinge rod out of the hinge sleeves and one or more modules or central parts 2 are placed successively on the lower part 3. Then corresponding hinge parts 40 are pushed into the rear wall of these central parts 2 and fixed there due to the interacting of resilient tongue 46 and detent nose 47. Also located in the columns are the corresponding locking bars, as described above for the lid. The handle 36 can then be fitted into one of the central parts 2, according to the desired balance. It goes without saying that during or after the placing on of the central parts 2, a corresponding connection by means of the connecting rod 7 and the slide 8 to the slide track 6 is also established.

If a module M is to be used as a drawer, it suffices if the lid 1 and the other modules are removed and instead a handle frame 86 is clipped onto the module M. Now this module can be laid on a corresponding drawer arrangement of a rack and it consequently serves as a drawer. If the module is required again for forming a case, it suffices to remove the handle frame 86 and in turn establish a connection with the other modules of the case R.

I claim:

1. A case of unitized construction for receiving and transporting articles, comprising a plurality of module elements stackable above each other, any two module elements adjacent to each other define a corresponding upper element and lower element, the upper element and lower element being jointly connected and releasably hinged to each other, the lower element having a receiving space for the articles, the upper element having a lid for closing the receiving space of the lower element, the case having at least one locking device for securing the position of corresponding upper and lower elements so as to close the receiving space of the lower element with the lid of the upper element, each of the elements having at least one basic shell with a base and a peripheral side shell with two side walls, a front wall, a rear wall and hinge sleeves arranged at the rear wall, the walls being of double-walled construction with outer and inner skins and enclosing a peripheral inner chamber having side, front and rear wall portions, one of the two side wall portions of the peripheral inner chamber of the lower element has a slide track and a slide arranged at a connecting rod articulated at the side wall portion of the corresponding upper element, and the upper element having at least one hinge fitted from below into the rear wall of the inner chamber to cooperate with a hinge sleeve of the corresponding lower element, whereby the slide track, slide and connecting rod of the corresponding upper and lower elements pivotally interact to provide for at least two positions of the corresponding upper and lower elements about the at least one hinge.

2. The case according to claim 1, wherein the at least one hinge has two hinge sleeves, between the hinge sleeves provides for a space for receiving a hinge sleeve of the basic shell of an adjacent element, and the hinge sleeves are seated on a bow having a wall from which at least one resilient tongue has been shaped out, which tongue interacts with a detent nose in the inner chamber of the rear wall.

3. The case according to claim 1, wherein one of the positions is defined by a detent recess, the slide track has an elongated guide track and a flexible strip, the detent recess is located at one end of the guide track, whereas the other end of the guide track, remote from the detent recess, together with the flexible strip forms a slit which can be varied in its width by elastic deformation of the strip, brought about by the slide, the guide track is designed as a rising surface and, together with a lower strip, forms a clasp-shaped central part, the flexible strip comprises a run-on strip and an adjoining sliding strip, which runs approximately in a plane of the guide track, whereas the run-on strip engages under the central part, the run-on strip is adjoined by an elongated basic strip, which runs under the guide track and also engages under the detent recess, and, at its end remote from the run-on strip and the flexible strip, the basic strip leads to an outlet out of the element.

4. The case according to claim 3, wherein the detent recess is bounded by a first hook, which together with a second hook and in extension of the guide track beyond the detent recess forms a passage for the slide, through which the slide can go onto the basic strip, the first hook being approximately straight and the second hook curved, and the outlet is located in a covering strip of the slide track, from which the second hook also bends off and which engages over the guide track.

5. The case according to claim 4, wherein the slide can be moved out of the detent recess against a flexible resistance of a securing element and, if appropriate, can be moved into the detent recess, and the securing element is designed as a flexible securing strip, which is arranged on a covering strip of the slide track approximately opposite the detent recess and together with the rising surface forms a constriction for the passing of the slide.

6. The case according to claim 4, wherein the second hook and the flexible securing strip are molded on together as an integral part on the covering strip.

7. The case according to claim 1, wherein columns which contain the locking device are molded onto the corner regions between the side walls and the front wall.

8. The case according to claim 7, wherein the column is closed at the top by a column top, in which there is made an opening for receiving a detent hook, which engages under a locking edge of the column top, the detent hook is molded onto the locking bar, fixed in the next-following module, and in this arrangement engages through a plate, or an arc segment cut out from the plate, the plate closes the column of the next-following module at the bottom, there rising up from the plate in the interior of the column two ribs, between which the locking bar is clamped, the locking bar striking with a push bar from outside against the column, then engaging with a locking-bar body, from which the detent hook also protrudes, through the arc segment and engaging opposite the detent hook with a pivot bolt in a pivot hole in the plate, and there protruding from the locking-bar body approximately radially with respect to the pivot bolt a spring leg, which is supported against a rib and presses a stop edge of the locking-bar body against the rib.

9. The case according to claim 7, wherein an undercut groove for receiving a molding of a handle is made in the column.

10. The case according to claim 1, wherein the module of the lower part is covered on the bottom at least partially by a blind frame.

11. The case according to claim 7, wherein the blind frame has hooks for clipping into corresponding detent locations in the basic shell.

12. The case according to claim 7, wherein the blind frame comprises side strips, a rear covering strip, on which small feet are molded, and a front strip and rings for column covering, in which there are fitted caps which stand up out of the plane of the rings.

13. The case according to claim 12, wherein the lid is constructed as a module having side walls, a rear wall with hinge sleeves, a front wall and columns with a plate and locking bar, but instead of a base has a covering plate, the columns are covered by clipped-in lid sheets, in which recesses are made for receiving caps of a case placed thereupon, a cover is clipped onto the covering plate in the rear region, and the cover has small feet, which interact with the small feet of the blind frame of a case arranged below it.

14. The case according to claim 1, wherein a handle frame can be clipped onto a module for converting the module into a drawer.

* * * * *